US006837394B2

(12) United States Patent
Nnamani

(10) Patent No.: US 6,837,394 B2
(45) Date of Patent: Jan. 4, 2005

(54) SANITARY DISPOSAL UNIT

(76) Inventor: Patricia Ann Nnamani, 705 Highland Ave., Chester, PA (US) 19103-2120

( * ) Notice: Subject to any disclaimer, the term of this patent is extended or adjusted under 35 U.S.C. 154(b) by 30 days.

(21) Appl. No.: 10/290,942

(22) Filed: Nov. 8, 2002

(65) Prior Publication Data

US 2004/0089665 A1 May 13, 2004

(51) Int. Cl.[7] ..... B65D 25/14
(52) U.S. Cl. ..... 220/495.08; 383/11; 383/52
(58) Field of Search ..... 220/495.08, 495.09, 220/495.11, 495.07, 908.1, 908.2, 910, 254; 383/11, 52

(56) References Cited

U.S. PATENT DOCUMENTS

| | | | | | |
|---|---|---|---|---|---|
| 1,964,513 | A | * | 6/1934 | Hammer | 220/254.2 |
| 3,148,799 | A | * | 9/1964 | Meroney | 220/495.11 |
| 3,167,241 | A | * | 1/1965 | Woerner | 383/52 |
| 3,207,355 | A | | 9/1965 | Saphier | |
| 4,458,962 | A | | 7/1984 | Pohl-Michel | |
| 4,948,266 | A | * | 8/1990 | Bencic | 383/34 |
| 4,964,523 | A | * | 10/1990 | Bieltvedt et al. | 220/553 |
| 5,040,903 | A | * | 8/1991 | Schramer | 383/70 |
| 5,259,503 | A | | 11/1993 | Steingraber, Jr. | |
| D366,743 | S | | 1/1996 | Davenport | |
| 5,492,238 | A | | 2/1996 | Scholl et al. | |
| 5,647,502 | A | * | 7/1997 | Marsh | 220/481 |
| 5,884,801 | A | * | 3/1999 | Simpson | 220/495.08 |
| 5,913,606 | A | * | 6/1999 | Nicholson | 383/11 |
| 6,029,844 | A | * | 2/2000 | Brady | 220/495.08 |
| 6,102,239 | A | * | 8/2000 | Wien | 220/495.07 |
| 6,234,339 | B1 | * | 5/2001 | Thomas | 220/495.07 |

FOREIGN PATENT DOCUMENTS

| | | |
|---|---|---|
| WO | WO 94/02097 | 2/1994 |

* cited by examiner

*Primary Examiner*—Joseph Man-Fu Moy
(74) *Attorney, Agent, or Firm*—Gene Scott; Patent Law & Venture Group

(57) ABSTRACT

A sanitary container apparatus comprises a base container; a container cap providing at least one door for insertion of sanitary products; and a container insert bag. The insert bag provides a peripheral adhesive layer on a top exterior surface and on a top interior surface thereof, whereby the insert bag may be adhered to an inside surface of the base container for maintaining the insert bag in an open attitude, and for sealing the insert bag upon removal of the insert bag from the container with the insert bag in a closed attitude.

5 Claims, 3 Drawing Sheets

SANITARY DISPOSAL UNIT

BACKGROUND OF THE INVENTION

INCORPORATION BY REFERENCE: Applicant(s) hereby incorporate herein by reference, any and all U.S. patents, U.S. patent applications, and other documents and printed matter cited or referred to in this application.

1. Field of the Invention

This invention relates generally to portable sanitary containers and more particularly to such a container having novel features.

2. Description of Related Art

The following art defines the present state of this field:

Davenport, U.S. Des. Pat. No. 366,743 describes a sanitary napkin receptacle design.

Saphier, U.S. Pat. No. 3,207,355 describes an off the floor refuse container comprising: a wall bracket, said wall bracket including a plate having a pair of hooks stamped out of the plane of said plate, a bucket having means for detachably connecting the same on said hooks, means for securing said bracket to a wall, said securing means including a strip of adhesive extending transversely of said plate adjacent to top and bottom-thereof, a portion of said plate below the lower most strip being bent outwardly from the wall to form a bumper for the lower portion of said bucket, a cover for said bucket, means for hingedly connecting said cover to the upper portion of said bracket, means for releasably latching said cover in operative closed position with respect to said bucket, said means including a latch pivotally connected to said cover, an actuator being pivotally connected to said cover, said actuator being operatively associated to said latch to effect displacement thereof when a force is applied to said actuator, a catch formed on said bucket for engaging said latch in the closed position of said cover, and spring means for normally biasing said latch and actuator toward inoperative opposition, Pohl-Michel, U.S. Pat. No. 4,458,962 describes a bin for collecting refuse or garbage, for example womens' sanitary towels or napkins, comprising a tall narrow container which is open at the top and closed by a removable cover which has a substantially horizontal top surface. Disposed on the front of the bin, just below the cover, is an insertion opening having a closure flap which can be selectively opened and closed. Disposed in the interior of the bin is a bag for receiving inserted refuse or garbage. The closure flap has a shield means which projects into the interior of the bin and which covers an upper edge of the bag suspended in the bin, in the region of the insertion opening, so that refuse or garbage which is put into the bin can pass into the bag and not between the bag and the adjacent wall of the bin. The bag has suspension means at the sides thereof by means of which it can be suspended from carrying handles which project from the sides of the bin. Desirably, the bag is impregnated with or contains a deodorant and/or disinfectant substance.

Steingraber, Jr., U.S. Pat. No. 5,259,503 describes a container of combustible material for disposal, in an ecologically satisfactory manner, of septic bodies, such as a used sanitary napkin, tampon or bandage. The container comprises two parts, with at least one part providing an open, obstructed space for the reception of the septic body. One of the parts of the container has an adhesive body which completely encircles it. The adhesive body is initially protected by a removable cover. When the parts are assembled, so that both parts are in contact with the adhesive, the adhesive provides a continuous bonding of the parts of the container to hermetically seal the container. The adhesive is sufficiently strong to prevent manual separation of the parts. The container may be used to ship and store an aseptic body, prior to use, and then be used for the reception, sealing and disposal of the same or a similar body which has become septic.

Scholl et al., U.S. Pat. No. 5,492,238 describes an arrangement for storing wastes for household and sanitary applications having a waste container, a cover for closing the waste container, a cover opening mechanism, and an understructure which is mountable on a wall and other element and formed so that the waste container is supported on the understructure turnably so that a turning of the waste container leads to an opening of the cover.

McDonald, WO 94/02097 describes a sanitary item disposal unit that is formed by a disposable bag having an accordion pleated collapsible wall which unfolds in a longitudinal extending action of the bag as the sanitary item is withdrawn from a cavity, through a central aperture in a support panel, into the bag. Respective end portions of the bag support panel are pressure tape scaled for closing the bag and disposal of the sanitary item with its bag container.

The prior art teaches waste containers, refuse receptacles and bins, containers for septic objects such as sanitary napkins such as Tampons, but does not teach a container with adhesive bag and cover for fully sanitary service. The present invention fulfills these needs and provides further related advantages as described in the following summary.

SUMMARY OF THE INVENTION

The present invention teaches certain benefits in construction and use which give rise to the objectives described below.

A sanitary container apparatus comprises a base container; a container cap providing at least one door for insertion of sanitary products; and a container insert bag. The insert bag provides a peripheral adhesive layer on a top exterior surface and on a top interior surface thereof, whereby the insert bag may be adhered to an inside surface of the base container for maintaining the insert bag in an open attitude, and for sealing the insert bag upon removal of the insert bag from the container with the insert bag in a closed attitude.

A primary objective of the present invention is to provide an apparatus and method of use of such apparatus that provides advantages not taught by the prior art.

Another objective is to provide such an invention capable of handling used sanitary products in a clean and septic manner.

A further objective is to provide such an invention capable of disposal of such sanitary products in a clean and septic manner.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
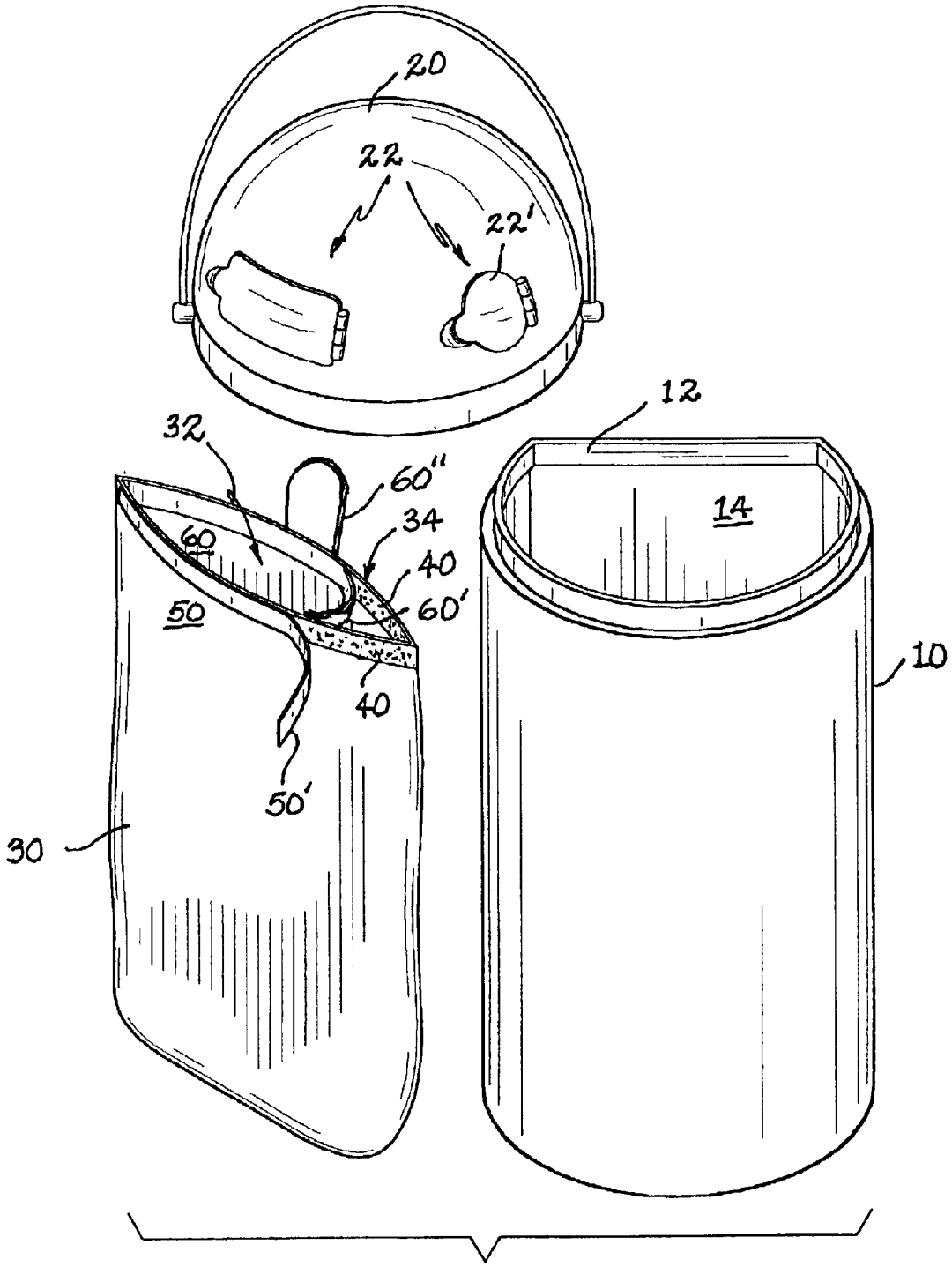
FIG. 1 is an exploded perspective view of the preferred embodiment of the invention showing three parts thereof.
Figure 2:
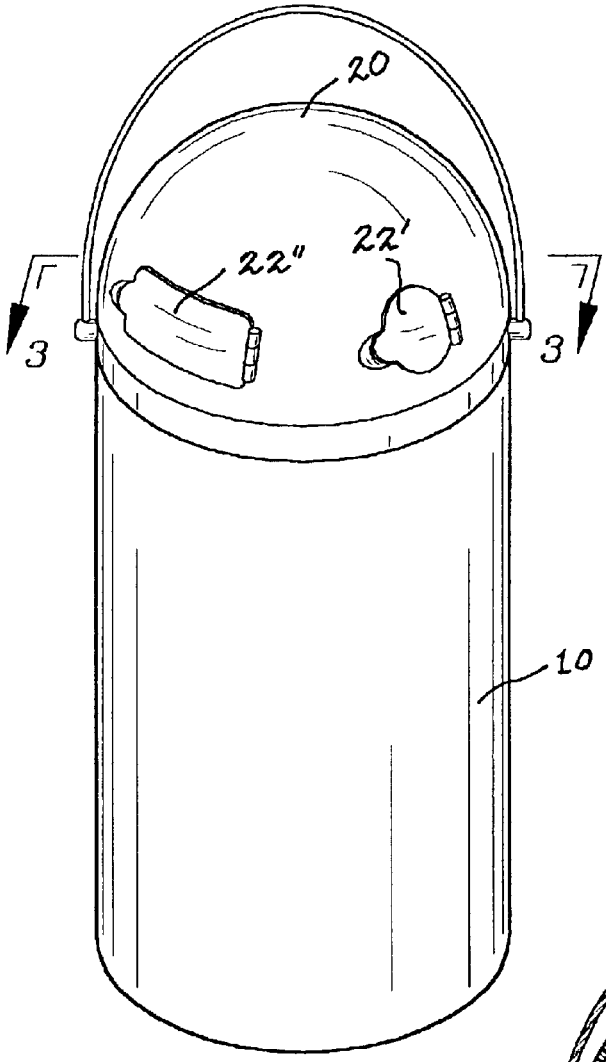
FIG. 2 is a perspective view thereof.
Figure 3:
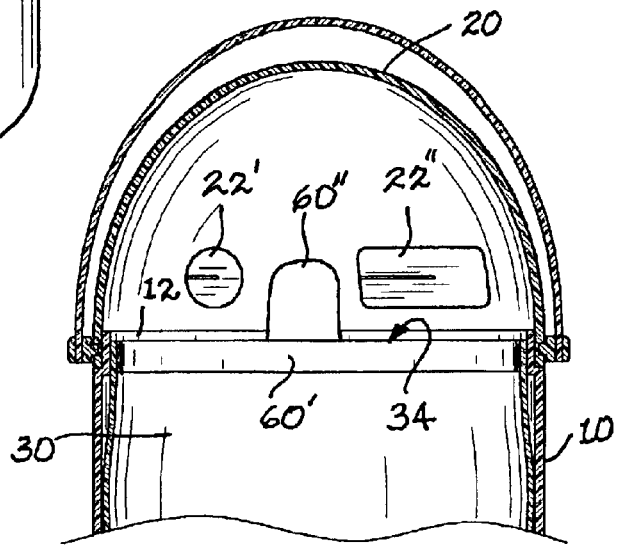
FIG. 3 is a partial sectional view thereof taken along line 3—3 in FIG. 2.

The present invention, as shown in FIG. 1, provides a sanitary container apparatus comprising: a base container 10; a container cap 20 providing at least one door 22 for insertion of sanitary products, the cap 20 being adapted for tight-fitting onto the base container 10 for dust-free closure; and a flexible container insert bag 30. The insert bag 30 provides a peripheral adhesive layer 40 on a top exterior surface 50 and on a top interior surface 60. These surfaces 50, 60 are adjacent to a bag aperture 32 through which soiled sanitary articles may be inserted into the insert bag 30. The insert bag 30 is preferably adhered to an inside surface 12 of the base container 10 using the adhesive layer 40 on the top exterior surface 50 for maintaining the insert bag 30 in an open attitude as shown in FIG. 3. When removed from the base container 10, the insert bag 30 is sealed using the adhesive layer 40 on the top interior surface 60. When sealed, the insert bag 30 may then be removed from the container 10 with the insert bag closed for improved sanitary handling.

The insert bag 30 preferably provides at least one tab 60" extending above a top peripheral edge 34 of the insert bag 30.

The insert bag 30 provides a pair of cover strips 50', 60' removeably secured over the adhesive layer 40. The cover strips 50' 60' are adapted for removal for exposing the adhesive layer 40. Such adaptation is well known in the art and may comprise a wax surface of the cover strip in contact with the adhesive layer 40, for instance.

The base container 10 preferably provides a flat rear panel 14 for placement of the base container 10 against a wall or other flat surface for convenience and space saving.

Figure 4:
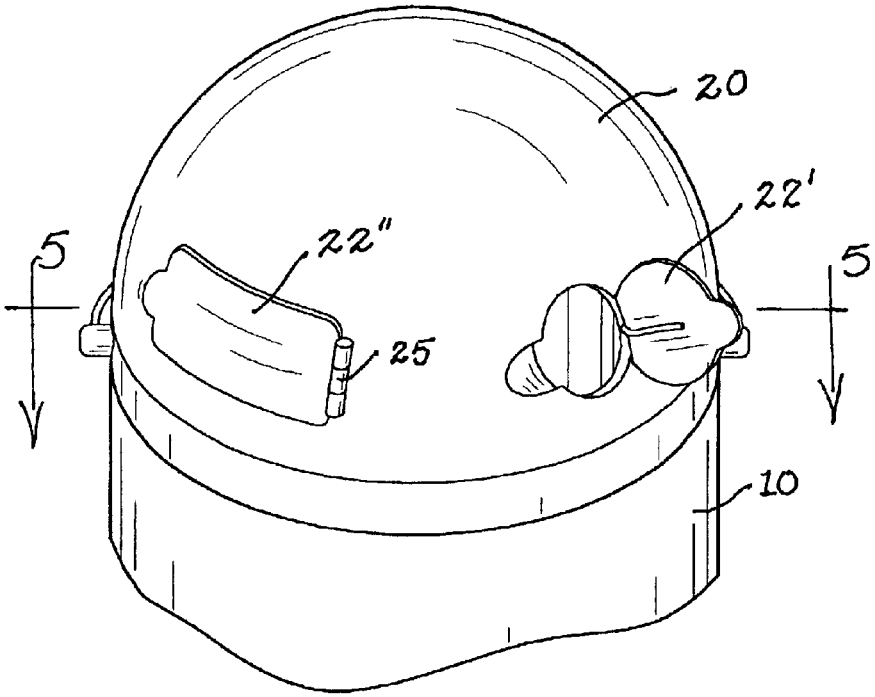
FIG. 4 is a partial perspective view of FIG. 2 showing a functional aperture thereof and wherein an insert bag of the invention is not shown.
Figure 5:
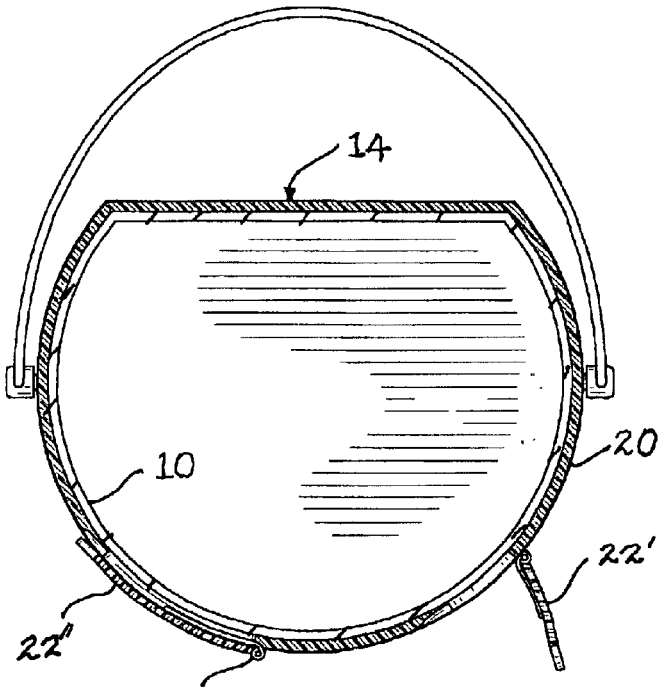
FIG. 5 is a sectional view thereof taken along line 5—5 in FIG. 4.

The at least one door for insertion of sanitary products 22 preferably comprises a first door 22' adapted by size and shape for receiving a round elongate sanitary product such as a Tampon® as clearly shown in FIG. 4, and a second door 22" adapted by size and shape for receiving a sanitary product having a rectangular cross-sectional shape such as a sanitary napkin. The first and second doors 22', 22" are mounted to the cap 20 on hinges 25 for moving between closed and open positions, as shown in FIG. 4, and have tight fitting closures for sanitary maintenance.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A sanitary container apparatus comprising: a base container having an open top; a container cap, for covering the open top of the base container; at least one door in the container cap for insertion of sanitary items into the base container; and a container insert bag, the insert bag providing a first continuous peripheral adhesive layer on an exterior surface of the insert bag, and a second continuous peripheral adhesive layer on an interior surface of the insert bag, the adhesive layers both placed evenly with a top edge of the insert bag for tight fitting of the insert bag against the inside surface of the base container; whereby the insert bag is adhered to the inside surface of the base container for maintaining the insert bag in an open attitude, and for closing and sealing the insert bag upon removal of the insert bag from the base container.

2. The apparatus of claim 1 wherein the insert bag provides at least one tab extending above a top peripheral edge of the insert bag.

3. The apparatus of claim 1 further comprising a pair of cover strips removeably secured over the adhesive layer, the cover strips adapted for removal for exposing the adhesive layer.

4. The apparatus of claim 1 wherein the base container provides a flat rear panel for placement of the base container against a wall.

5. The apparatus of claim 1 wherein the at least one door for insertion of sanitary products comprises a first door adapted by size and shape for receiving a round elongate sanitary product, and a second door adapted by size and shape for receiving a sanitary product having a rectangular cross-sectional shape, the first and second doors providing hinges for moving between closed and open positions and tight fitting closures for sanitary maintenance.

* * * * *